US009368890B1

(12) United States Patent
Liao

(10) Patent No.: US 9,368,890 B1
(45) Date of Patent: Jun. 14, 2016

(54) ELECTRICAL CONNECTOR ASSEMBLY

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/789,097

(22) Filed: Jul. 1, 2015

(51) Int. Cl.

| | |
|---|---|
| ***H01R 12/00*** | (2006.01) |
| ***H01R 12/72*** | (2011.01) |
| ***H01R 43/26*** | (2006.01) |
| *H01R 12/52* | (2011.01) |
| *H01R 13/514* | (2006.01) |

(52) U.S. Cl.
CPC ..... *H01R 12/722* (2013.01); *H01R 43/26* (2013.01); *H01R 12/52* (2013.01); *H01R 13/514* (2013.01)

(58) Field of Classification Search
USPC ..... 439/66, 70, 71
See application file for complete search history.

(56) References Cited

U.S. PATENT DOCUMENTS

| | | | | |
|---|---|---|---|---|
| 4,552,422 | A * | 11/1985 | Bennett | H05K 7/1084 361/783 |
| 6,679,707 | B1 | 1/2004 | Brodsky et al. | |
| 6,881,073 | B2 | 4/2005 | Bali et al. | |
| 7,686,620 | B2 | 3/2010 | Liao et al. | |
| 7,726,977 | B2 * | 6/2010 | Hsu | H01R 13/502 439/71 |
| 7,819,669 | B2 | 10/2010 | Liao et al. | |
| 2006/0094266 | A1 * | 5/2006 | Liao | H01R 13/2442 439/71 |
| 2008/0220632 | A1 * | 9/2008 | Chang | H01R 13/514 439/74 |

* cited by examiner

*Primary Examiner* — Tho D Ta
(74) *Attorney, Agent, or Firm* — Wei Te Chung; Ming Chieh Chang

(57) ABSTRACT

An electrical connector assembly essentially consists of four connector units neighboring with one another each occupying a quadrant in a square manner so that each connector units defines two unexposed neighboring sides and two exposed outer sides. Each connector unit includes an insulative housing with a plurality of passageways to receive the corresponding contacts therein. A vertically and horizontally staggered structure is formed on each neighboring side of the housing. A pair of inner interengaging structures and a pair of outer neighboring structures are respectively formed on two opposite ends of the corresponding neighboring sides of the neighboring connector units so as to allow the neighboring connector units to be assembled in a pivotal way with the pair of outer interengaging structures as a fulcrum.

18 Claims, 9 Drawing Sheets

ELECTRICAL CONNECTOR ASSEMBLY

1. FIELD OF THE INVENTION

The present invention relates to an electrical connector assembly, and more particularly to an electrical connector assembly formed by a plurality of connector units which are assembled together.

2. DESCRIPTION OF THE PRIOR ART

U.S. Pat. Nos. 6,679,707 and 6,881,073 both disclose an electrical connector assembly formed by four connector units/wafers in a square manner. Although some interengaging structures are provided for retaining the neighboring connector units attached to each other in a fixed state in a vertical direction. Anyhow, a frame structure is required to cooperate with and integrate those connector units for forming a complete socket thereof. To provide the fixation between the neighboring units in the horizontal direction, U.S. Pat. No. 7,686,620 discloses an interengaging structures of the post and the hole.

It is desired to obtain a new electrical socket with the corresponding connector units/wafers assembled with one another in a reliable fixed manner in both vertical and horizontal direction and with an easy rotational assembling way even optionally without necessity of the surrounding frame associated therewith.

SUMMARY OF THE INVENTION

Accordingly, an object of the present invention is to provide an electrical connector assembly including a plurality of connector units arranged in square manner.

In order to achieve the object set forth, an electrical connector assembly essentially consists of four connector units neighboring with one another each occupying a quadrant in a square manner so that each connector units defines two unexposed neighboring sides and two exposed outer sides. Each connector unit includes an insulative housing with a plurality of passageways to receive the corresponding contacts therein. Each of the contact has two opposite contacting arms extending out of opposite upper and bottom surfaces of the housing. A vertically and horizontally staggered structure is formed on each neighboring side of the housing so as to cooperate with the similar vertically and horizontally staggered structure of the neighboring connector unit for fastening therebetween in the vertical direction and one horizontal direction along the neighboring side. A pair of inner interengaging structures and a pair of outer neighboring structures are respectively formed on two opposite ends of the corresponding neighboring sides of the neighboring connector units so as to allow the neighboring connector units to be assembled in a pivotal way with the pair of outer interengaging structures as a fulcrum.

DESCRIPTION OF PREFERRED EMBODIMENT

Reference will now be made to the drawings to describe the present invention in detail.

Figure 1:
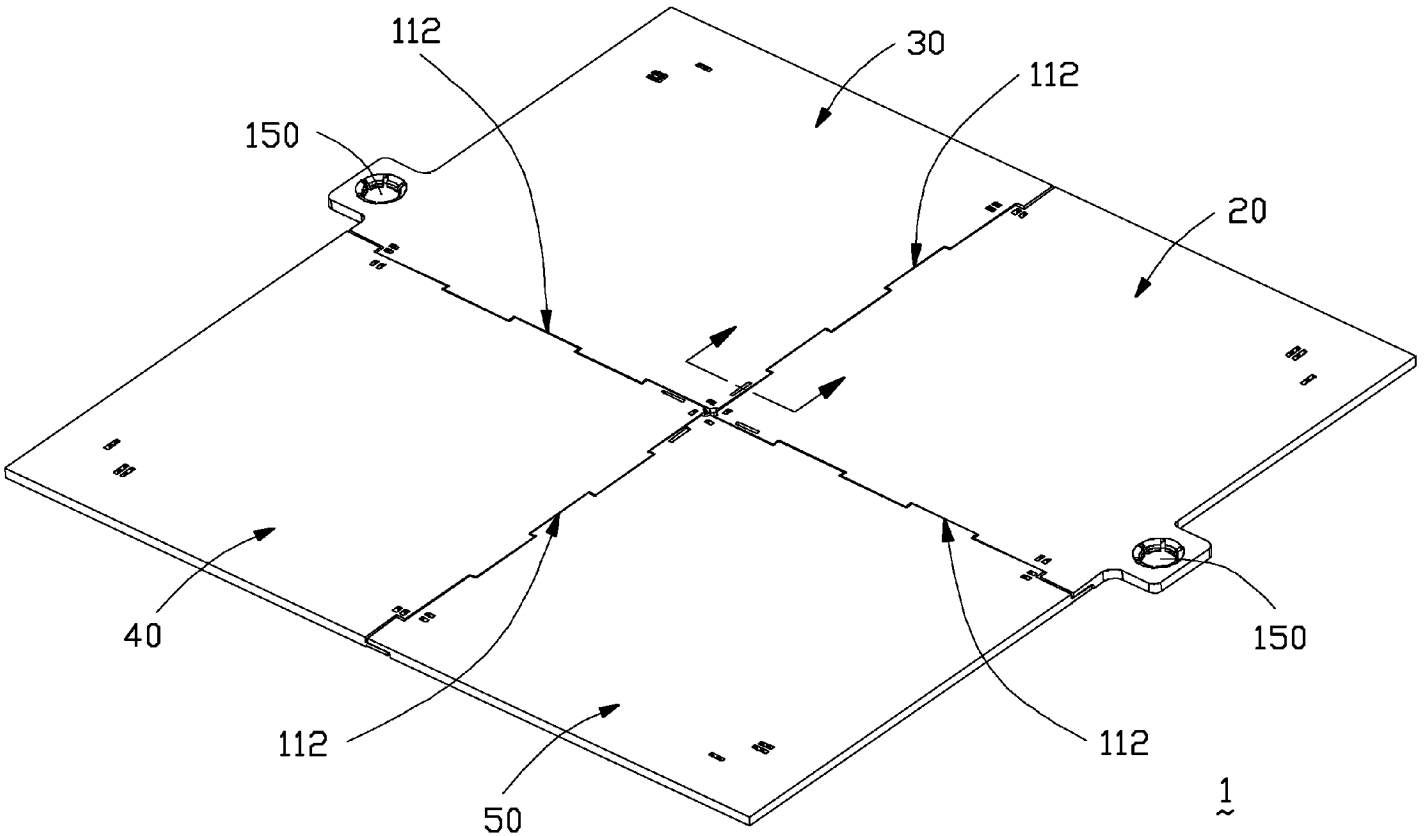
FIG. 1 is an assembled perspective view of an electrical connector assembly in accordance with a preferred embodiment of the present invention.
Figure 2:
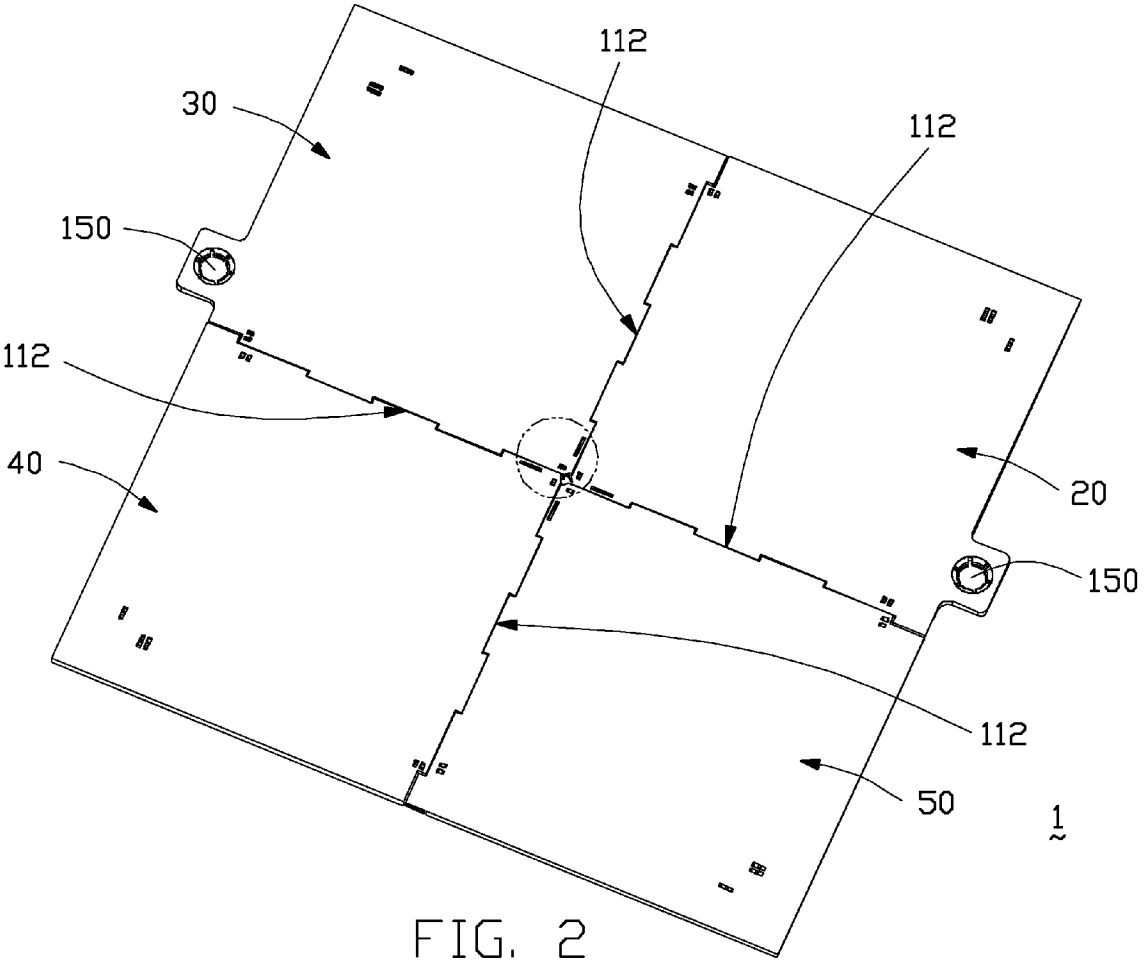
FIG. 2 is a downward perspective view of the electrical connector assembly of FIG. 1.
Figure 3:
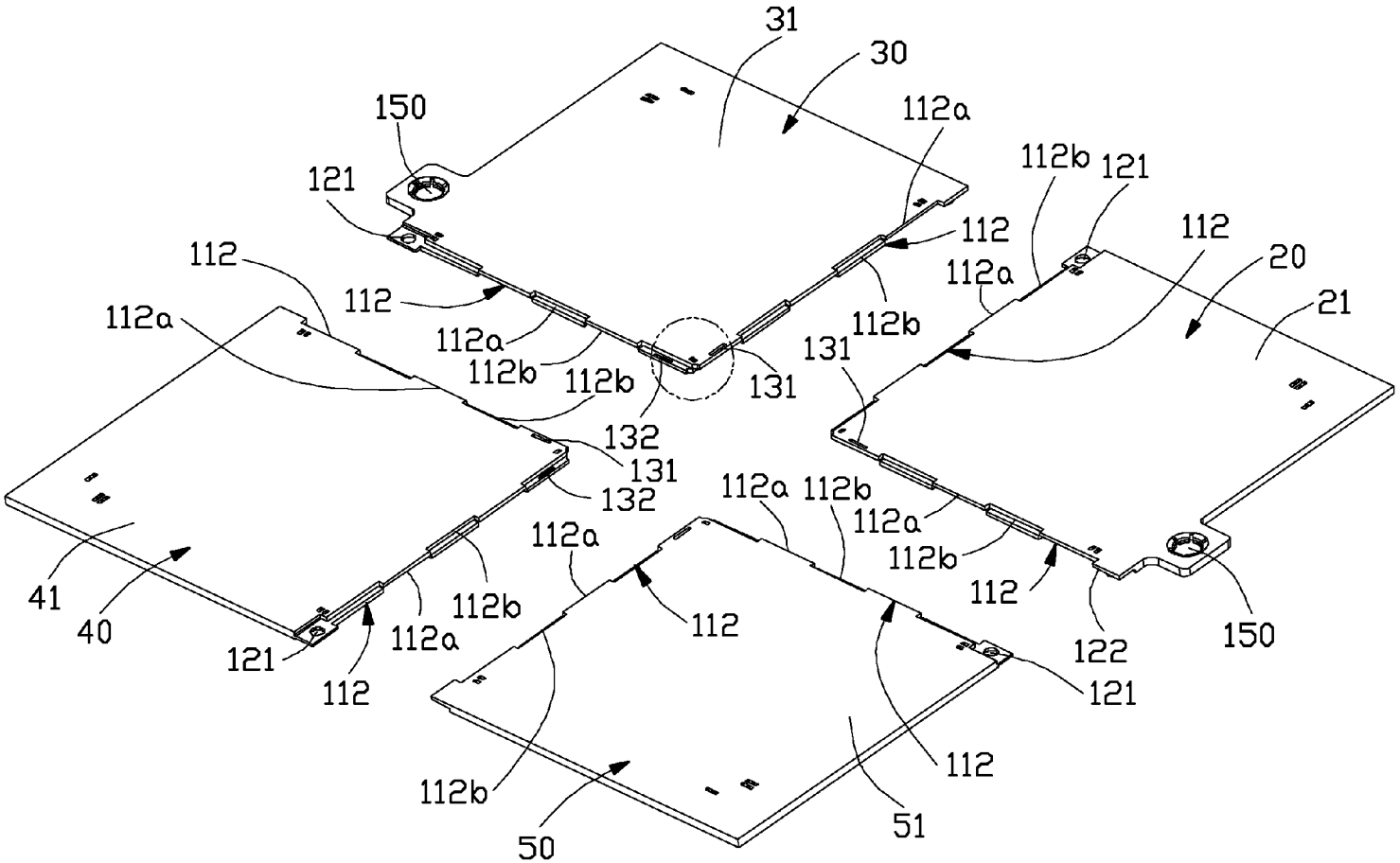
FIG. 3 is an exploded downward perspective view of the electrical connector assembly of FIG. 1.
Figure 4:
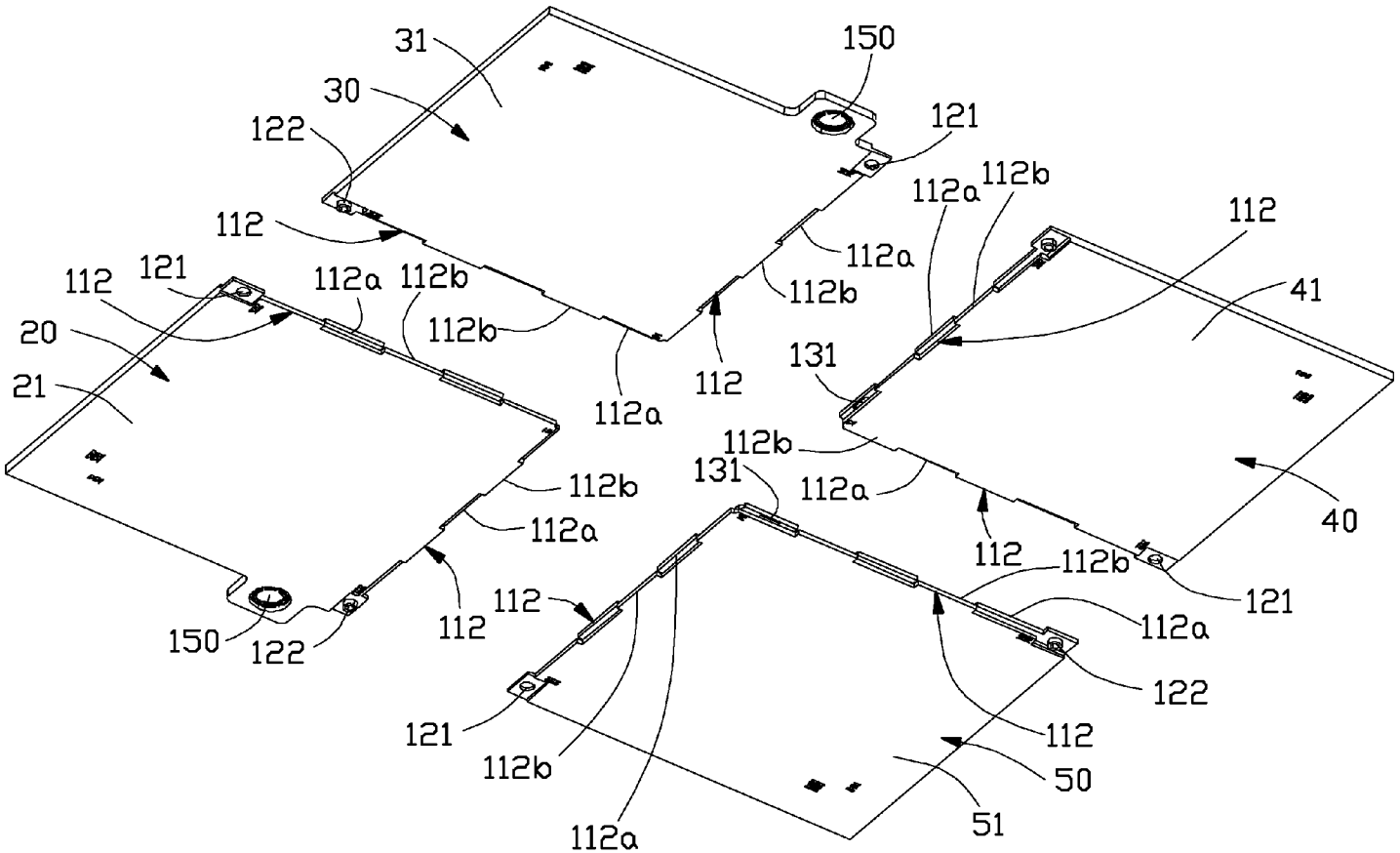
FIG. 4 is an exploded upward perspective view of the electrical connector assembly of FIG. 1.
Figure 5:
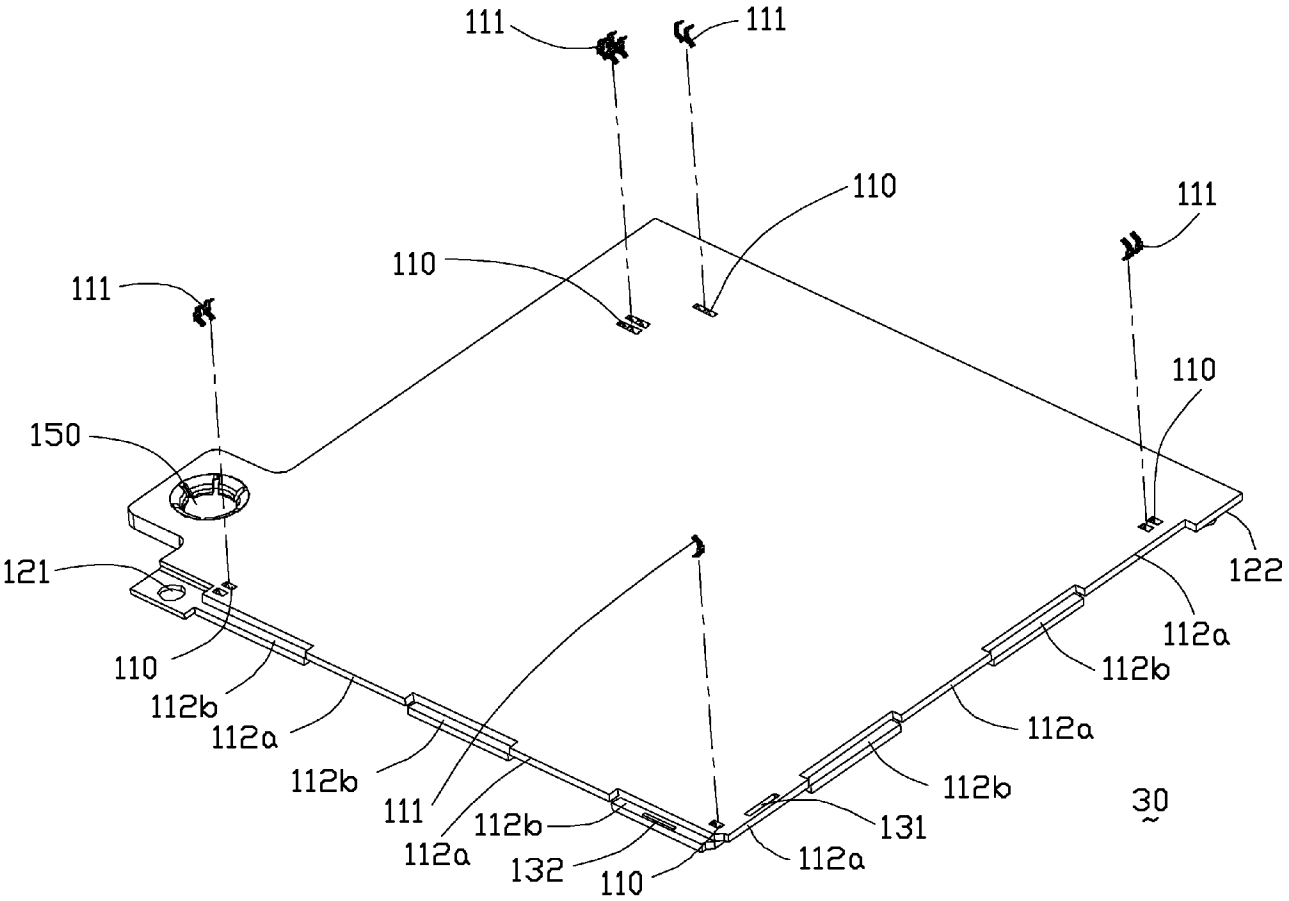
FIG. 5 is a downward perspective view of one electrical connector unit of the electrical connector assembly of FIG. 1.
Figure 6:
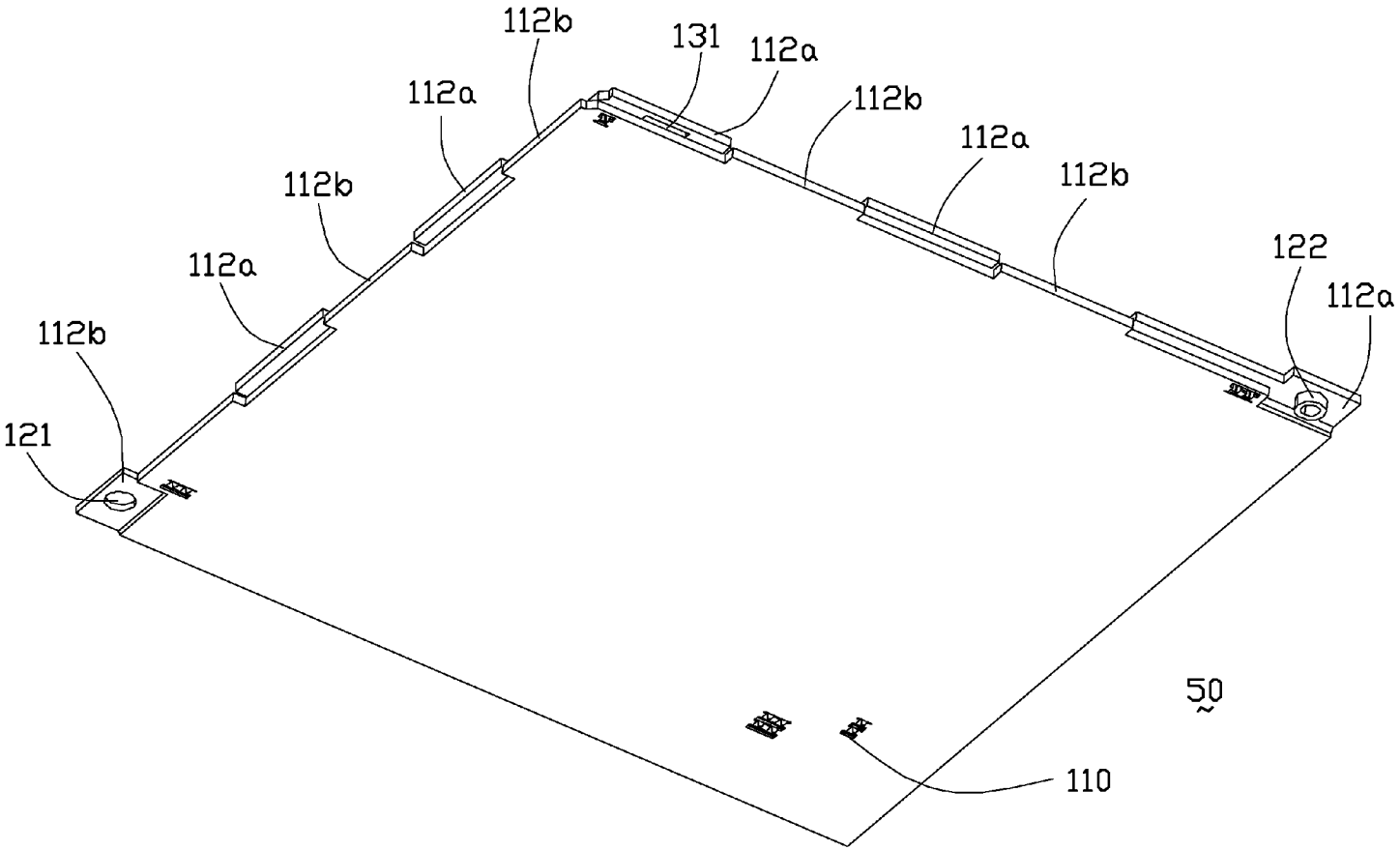
FIG. 6 is an upward perspective view of another one electrical connector unit of the electrical connector assembly of FIG. 1.
Figure 7:
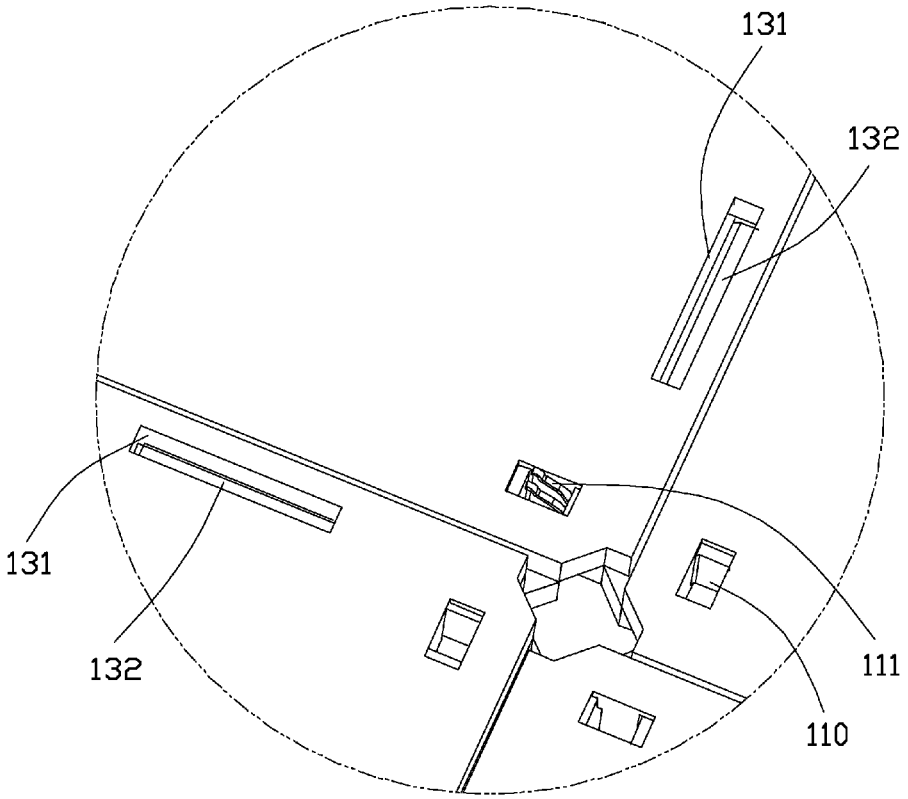
FIG. 7 is an enlarged perspective view of a center portion of the electrical connector assembly of FIG. 2.
Figure 8:
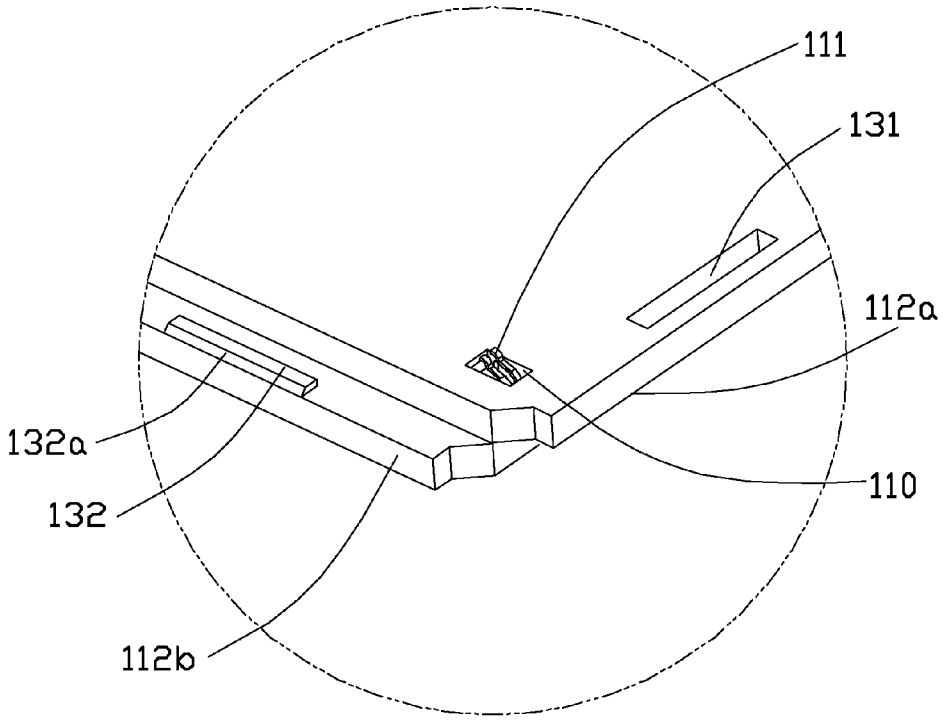
FIG. 8 is an enlarged perspective view of an inner portion of the connector unit of the electrical connector assembly of FIG. 3.
Figure 9:
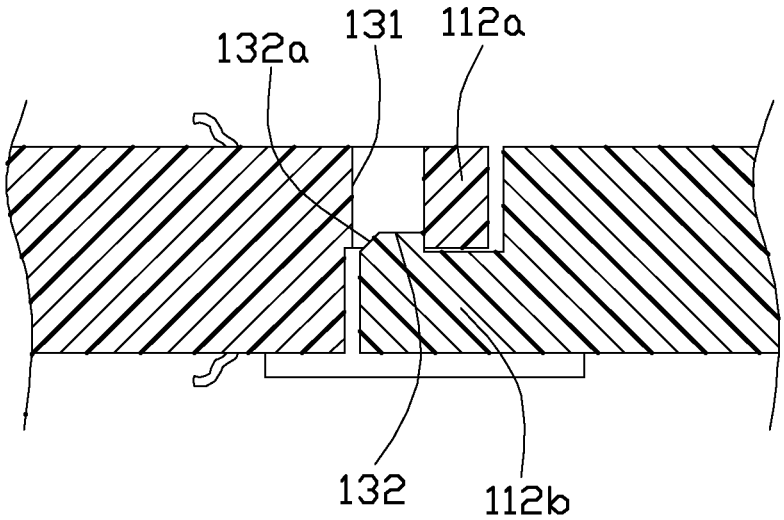
FIG. 9 is a cross-sectional view of the corresponding inner portions of the two neighboring connector units of the electrical connector assembly of FIG. 1

Referring to FIGS. 1-9, an electrical connector assembly 1 essentially consists of four connector units 20, 30, 40, and 50 which are assembled with one another in a square manner, each occupying a corresponding quadrant. The connector units 20, 30, 40 and 50 are essentially similar with one another and each connector unit includes a square insulative housing 21, 31, 41 and 51 with corresponding passageways 110 to receive the corresponding contacts 111, respectively. A vertically and horizontally staggered structure 112 is formed on a neighboring side of each connector unit 20/30/40/50 so as to cooperate with and interengage with the corresponding vertically and horizontally staggered structure of the neighboring connector unit to secure the neighboring connector units in the vertical direction and the horizontal direction along the neighboring side, once assembled. The vertically and horizontally staggered structure 112 essentially includes a plurality of upper parts 112*a* and a plurality of lower parts 112*b* alternately arranged with each other along the corresponding side.

A pair of outer interengaging structures are respectively formed at outer ends of the neighboring sides of the neighboring connector units, and include a hole 121 in the lower part 112*b* of one connector unit and a post 122 on the upper part 112*a* of the other connector unit of the corresponding neighboring connector units. Via the post 122 within the hole 121, the outer interengaging structures function not only to be a fastening device for assuring fixation between the neighboring connector units in the horizontal direction but also to be a fulcrum/pivotal point to allow the corresponding neighboring connector units to be pivotally assembled to each other until the vertically and horizontally staggered structure 112 on the neighboring sides of the neighboring connector units are completely attached to each other. A pair of inner interengaging structures are respectively formed at inner ends of the neighboring sides of the neighboring connector units, and include a cutout 131 in the upper part 112*a* of one connector unit and a protruding bar 132 on the lower part 112*b* of the other connector unit of the corresponding neighboring connector units. Via the protruding arm 132 received within the cutout 131, the inner interengaging structures provides the horizontal retention between the two neighboring connector units not only in the horizontal direction along the neighboring sides but also in the transverse direction perpendicular to the mating sides. The protruding bar 132 is further equipped with a lead-in tapered face 132*a* for easing assembling the protruding bar 132 into the corresponding cutout 131 during such a rotational assembling which is pivotal about the outer interengaging structures. Therefore, the connector units 20/30/40/50 can be secured with one another around the center region via those inner interengaging structures. In other words, the whole connector assembly can be assembled via a procedure as follows:

(i) assembling the connector units 20 and 30 with each other in a rotational way with a pivotal at the outer interengaging structures until the inner interengaging structures are engaged/locked with each other and the corresponding vertically and horizontally staggered structures are engaged with each other in the vertical direction and the horizontal direction along the neighboring sides;

(ii) assembling the connector units 30 and 40 with each other in a rotational way with a pivotal at the outer interengaging structures until the inner interengaging structures are engaged/locked with each other and the corresponding vertically and horizontally staggered structures are engaged with each other in the vertical direction and the horizontal direction along the neighboring sides; and (iii) assembling the connector units 40 and 50 with each other in a rotational way with a pivotal at the outer interengaging structures until the inner interengaging structures are engaged/locked with each other and the corresponding vertically and horizontally staggered structures are engaged with each other in the vertical direction and the horizontal direction along the neighboring sides.

It is noted that when the connector units 50 is completely assembled with the connector unit 40, it is also completely assembled with the connector unit 20 with the corresponding vertically and horizontally staggered structures are engaged with each other and the corresponding inner interengaging structures and outer interengaging structures are also engaged with each other. Therefore, the connector units 20/30/40/50 are assembled together, via the so-called rotational way, with respectively occupying four different quadrants of one unitary piece and with the center region lock via the inner interengaging structures 121/122 and outer/periphery region lock via the outer interengaging structures 131/132 and the boundary neighboring sides via the vertically and horizontally staggered structures 112. It is further noted that the horizontal retention provide by the outer interengaging structure is much stronger than that provided by the inner interengaging structure so as to facilitate the rotational assembling about the outer interengaging structure.

In this embodiment, each of the connector unit 20 and the connector unit 30 further includes a mounting/alignment hole structure 150 for mounting to an external structure, e.g., a printed circuit board. Optionally, the additional inner interengaging structure 121/122 may be optionally formed on the vertically and horizontally staggered structure between the corresponding inner interengaging structure 121/122 and the outer interengaging structure 131/132, if necessary.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

four connector units assemble with one another in a square manner and occupying four different quadrants, respectively;

each of said connector units defining a square configuration and including two neighboring sides interfaced with the corresponding neighboring connector units, and each of said connector units including an insulative housing with a plurality of contacts therein; wherein each of said neighboring sides defines a vertically staggered structure with opposite upper parts and lower parts alternately arranged with each other therealong so as to cooperate with the vertically and horizontally staggered structure of the neighboring connector units to provide at least vertical retention between the neighboring connector units, and an inner interengaging structure and an outer interengaging structure are located at two opposite ends of said vertically and horizontally staggered structure so as to cooperate with the corresponding inner interengaging structure and outer interengaging structure to further provide horizontal retention between the neighboring connector units; wherein in each of said connector units, one of said inner interengaging structure and said outer interengaging structure is configured with a round structure so as to function as a pivot during a rotational assembling between the neighboring connector units.

2. The electrical connector assembly as claimed in claim 1, wherein some of said four connector units further includes a mounting/alignment hole in an outer side different from the neighboring sides.

3. The electrical connector assembly as claimed in claim 1, wherein the other of said inner interengaging structure and said outer interengaging structure is of an elongated structure along the corresponding neighboring side.

4. The electrical connector assembly as claimed in claim 3, wherein for every two neighboring connector units, the outer interengaging structure of one connector unit is a round post and the outer interengaging structure of the other connector is a round hole.

5. The electrical connector assembly as claimed in claim 3, wherein for every two neighboring connector units, the inner interengaging structure of one connector unit is a protruding bar and the inner interengaging structure of the other connector unit is a elongated cutout.

6. The electrical connector assembly as claimed in claim 4, wherein one of said elongated cutout and said protruding bar forms a lead-in surface for easing the rotational assembling.

7. The electrical connector assembly as claimed in claim 1, wherein said vertically staggered structure is also horizontally staggered so as to provide horizontal retention with the neighboring connector unit.

8. The electrical connector assembly as claimed in claim 7, wherein said vertically staggered structure includes a plurality of upper part and a plurality of lower parts alternately arranged with each other along the neighboring side.

9. A method of making an electrical connector assembly, comprising steps of:

providing four neighboring connector units, each including an insulative housing with a plurality of contacts therein;

arranging said four connector units, in a square manner, each occupying different quadrants and defining two neighboring sides for engagement with the corresponding neighboring sides of the neighboring connector units, respectively, providing each neighboring side of each neighboring connector unit with a vertically staggered structure so as to provide vertical retention between the neighboring connector units once assembled;

providing an inner interengaging structure at an inner end of the neighboring side and an outer interengaging structure at the outer end of the neighboring side; wherein the outer interengaging structure is formed with a round configuration while the inner interengaging structure is formed with a lead-in mechanism so as to assemble the neighboring connector units in a rotational way essentially about said outer interengaging structure.

10. The method as claimed in claim 9, wherein some of the connector units further includes a mounting/alignment hole in an outer side different from the neighboring sides.

11. The method as claimed in claim 9, wherein one outer interengaging structure in one connector unit is a round hole and another outer interengaging structure on the neighboring connector unit is a round post while one inner interengaging structure in one connector unit is an elongate cutout and another inner interengaging structure on the neighboring connector unit is a protruding bar.

12. The method as claimed in claim 9, wherein both said inner interengaging structure and said outer interengaging structure are configured to provide the horizontal retention between the neighboring connector units.

13. The method as claimed in claim 12, wherein said vertically staggered structure further staggered in a horizontal direction along said neighboring side so as to provide horizontal retention along the neighboring sides.

14. An electrical connector assembly comprising:

four connector units each defining a plurality of neighboring sides for coupling to the neighboring connector units, respectively, said four connector units arranged in a square manner, occupying different quadrants, respectively;

each neighboring side being equipped with a vertically staggered structure to provide vertical retention between the neighboring connector units, and an inner interengaging structure and an outer interengaging structure being respectively located at opposite inner and outer ends of said vertically staggered structure to provide horizontal retention between the neighboring connector units; wherein the outer interengaging structures form horizontal retention among the connector units in a periphery region, and the inner interengaging structures form horizontal retention among the connector units around a center region; wherein one of said inner interengaging structure and said outer interengaging structure defines a round configuration for rotational assembling consideration between the neighboring connector units while the other of said inner interengaging structure and said outer interengaging structure defines slighter horizontal retention than said one of said inner interengaging structure and said outer interengaging structure for said rotational assembling consideration.

15. The electrical connector assembly as claimed in claim 14, wherein said one of said inner interengaging structure and said outer interengaging structure is the outer interengaging structure, and said other of said inner interengaging structure and said outer interengaging structure is the inner interengaging structure.

16. The electrical connector assembly as claimed in claim 14, wherein said other of said inner interengaging structure and said outer interengaging structure further defines a lead-in surface for easing finalization of the rotational assembling consideration.

17. The electrical connector assembly as claimed in claim 14, wherein some of said connector units each further include a mounting/alignment hole in an outer side different from the neighboring sides.

18. The electrical connector assembly as claimed in claim 14, wherein the outer interengaging structure includes a round post and a round hole mechanism, and the inner interengaging structure includes a protruding bar and the elongated cutout mechanism, and each connector unit includes mutually exclusively either a set of the round post and the elongated cutout, or a set of protruding bar and the round hole.

* * * * *